US007456806B2

(12) United States Patent
Moon et al.

(10) Patent No.: US 7,456,806 B2
(45) Date of Patent: Nov. 25, 2008

(54) PLASMA DISPLAY PANEL FOR MULTI-SCREEN

(75) Inventors: Seok Joon Moon, Gyoungsangbuk-do (KR); Min Soo Kim, Gyoungsangbuk-do (KR)

(73) Assignee: Orion PDP Co., Ltd., Kyungsangbuk-do (KR)

( * ) Notice: Subject to any disclaimer, the term of this patent is extended or adjusted under 35 U.S.C. 154(b) by 140 days.

(21) Appl. No.: 10/538,497

(22) PCT Filed: Dec. 9, 2003

(86) PCT No.: PCT/KR03/02695

§ 371 (c)(1),
(2), (4) Date: Apr. 11, 2006

(87) PCT Pub. No.: WO2004/053917

PCT Pub. Date: Jun. 24, 2004

(65) Prior Publication Data

US 2007/0001930 A1 Jan. 4, 2007

(30) Foreign Application Priority Data

Dec. 10, 2002 (KR) ..... 10-2002-0078268
Dec. 11, 2002 (KR) ..... 10-2002-0078713

(51) Int. Cl.
*G09G 3/28* (2006.01)

(52) U.S. Cl. ..... 345/60; 345/41

(58) Field of Classification Search ..... 345/41, 345/60

See application file for complete search history.

(56) References Cited

U.S. PATENT DOCUMENTS

| | | | | |
|---|---|---|---|---|
| 6,219,012 | B1 * | 4/2001 | Holtslag | 345/60 |
| 6,340,960 | B1 * | 1/2002 | Song et al. | 345/60 |
| 6,411,035 | B1 | 6/2002 | Marcotte | |
| 6,448,947 | B1 * | 9/2002 | Nagai | 345/60 |
| 6,522,314 | B1 * | 2/2003 | Tomio et al. | 345/68 |
| 6,727,869 | B1 * | 4/2004 | Kosaka | 345/60 |
| 7,023,403 | B2 * | 4/2006 | Setoguchi et al. | 345/60 |
| 7,098,873 | B2 * | 8/2006 | Homma | 345/60 |
| 7,167,146 | B2 * | 1/2007 | Kang | 345/68 |
| 2001/0005190 | A1 * | 6/2001 | Furutani | 345/60 |
| 2001/0020923 | A1 * | 9/2001 | Homma | 345/60 |
| 2002/0097200 | A1 * | 7/2002 | Setoguchi et al. | 345/60 |

(Continued)

FOREIGN PATENT DOCUMENTS

JP 2003-100213 4/2003

(Continued)

*Primary Examiner*—Bipin Shalwala
*Assistant Examiner*—Afroza Y Chowdhury
(74) *Attorney, Agent, or Firm*—Merchant & Gould P.C.

(57) ABSTRACT

The present invention relates to a multi-screen plasma display panel having improved structures of a sustain electrode and a scan electrode used in configuration of a multi-screen, thereby improving an operation characteristic and a brightness. In a unit plasma display panel, a front panel whereon a sustain electrode and a scan electrode are formed are sealed with a rear panel whereon an address electrode is formed. A multi-screen is formed by combining a plurality of the unit plasma display panels. End portions of the sustain electrodes to receive scan signals form a common electrode connected to the scan electrode, and the sustain electrode is configured to receive a sustain signal from the common electrode.

4 Claims, 6 Drawing Sheets

U.S. PATENT DOCUMENTS

| | | | | |
|---|---|---|---|---|
| 2003/0058194 | A1* | 3/2003 | Kang | 345/63 |
| 2003/0160569 | A1* | 8/2003 | Kim et al. | 315/169.1 |
| 2005/0078059 | A1* | 4/2005 | Kim | 345/60 |

FOREIGN PATENT DOCUMENTS

| | | |
|---|---|---|
| KR | 1998-075059 | 11/1998 |
| KR | 1019980075059 | * 10/1999 |
| KR | 2000-0044624 | 7/2000 |
| KR | 2001-0082878 | 8/2001 |
| WO | 00/70643 | 11/2000 |

* cited by examiner

PLASMA DISPLAY PANEL FOR MULTI-SCREEN

TECHNICAL FIELD

The present invention relates to a plasma display panel (hereinafter, referred to as "PDP"), and more specifically, to a plasma display panel for a multi-screen having improved structures of a sustain electrode and a scan electrode used in configuration of a multi-screen, thereby improving an operation characteristic and a brightness.

BACKGROUND ART

A PDP is a light emitting device for displaying image by exciting phosphor in a discharged cell to display image. The PDP is lighter and simpler in a fabrication process than a conventional CRT (Cathode Ray Tube), and enables a PDP monitor to be slimmer and a screen to be wider. As a result, the PDP has been frequently used for a situation board of stock exchange, a display device for a video conference and a wide screen for wall TV.

As shown in FIG. 1, in the conventional PDP, a front panel 10 is combined with a rear panel 20, and an image is displayed toward the front panel 10.

On the front panel 10, a sustain electrode X and a scan electrode Y are formed in parallel, and the sustain electrode X and the scan electrode Y comprise transparent electrodes Xa and Ya (or ITO electrodes) formed of an ITO material and bus electrodes Xb and Yb formed of an metal material.

The sustain electrode X and the scan electrode Y are covered with a dielectric film 12 for insulating both electrodes and restricting discharge current. A protective film 13 is formed on the dielectric film 12.

On the rear panel 20, barrier ribs 21 having a stripe type (or dot type) are formed in parallel. A discharge space, that is a cell C, is formed between the barrier ribs 21. An address electrode A is formed under the cell C, and covered with the dielectric film 23. A fluorescent film 24 is covered on a sidewall and a bottom of the cell C to represent red, green or blue.

If the cell C is discharged, visible rays of a corresponding color are emitted.

Although the PDP having the above-described structure has been developed to have a size of 63 inch, the embodiment of a wider screen is required.

In order to solve this problem, a multi-screen using the PDP may be provided as shown in FIG. 2. The multi-screen of FIG. 2 is formed by combining four PDPs (D1, D2, D3 and D4) to form a wide screen.

As shown in FIG. 2, each PDP used in configuration of the multi-screen has two surfaces to be adjacent to different PDPs. As a result, withdrawal directions of each electrode are limited. Thus, the sustain electrode X and the scan electrode Y are withdrawn in parallel toward the same direction, and the address electrode A is withdrawn perpendicular to the above electrodes X and Y.

Since the sustain electrode X and the scan electrode Y are withdrawn toward a peripheral portion of the PDP, a sustain signal and a scan signal are required to be applied from the same peripheral portion. However, the waveforms of the signals are more distorted as cells are farther from the peripheral portion of the PDP.

As shown in FIG. 3, pulses applied to an electrode pad are more distorted as they are transmitted into regions ①, ②, ③, ④ and ⑤. As a result, a pulse type transmitted from the region ① has a large difference from that of the region ⑤.

As described above, since the conventional PDP has more distorted waveforms of the pulses as the pulses are transmitted farther from application locations, discharge voltage conditions are differentiated depending on the positions of the PDP.

The PDP has a larger resistance as a region is farther from an electrode pad. As a result, in the scan signal and the sustain signal, a difference in signal loss is generated by the resistance, thereby differentiating the brightness in each region. That is, as a region is farther from the electrode pad, the brightness becomes lower.

Specifically, as a measurement result of the brightness in positions P1, P2 and P3 of FIG. 3, the position P1 shows the brightness of 210 Cd/m$^3$, the position P2 shows the brightness of 190 Cd/m$^3$ and the position P3 shows the brightness of 160 Cd/m$^3$.

DETAILED DESCRIPTION OF THE INVENTION

Accordingly, it is an object of the present invention to improve a structure of an electrode of a plasma display panel to reduce a brightness difference resulting from waveform distortion and a difference of discharge voltage conditions, thereby improving display quality.

It is another object of the present invention to uniformize the brightness of the whole surface by uniformizing effects on resistant factors in each region of the plasma display panel.

In an embodiment, a plasma display panel for a multi-screen comprises a plurality of unit plasma display panels wherein a front panel whereon a sustain electrode and a scan electrode are formed is sealed with a rear panel whereon an address electrode is formed. Here, end portions of the sustain electrodes located opposite to receive scan signals in the scan electrode form a common electrode, and the sustain electrode is configured to receive the sustain signal from the common electrode.

Here, each of the common electrodes of the sustain electrode of at least two or more plasma display panels is connected in common, and each of the plasma display panels receive the sustain signal in common.

The common electrode is formed on a sidewall of the front panel located in a place adjacent to different plasma display panels.

In another embodiment, a plasma display panel for a multi-screen is formed by combining a plurality of unit plasma display panels wherein a front panel whereon a sustain electrode and a scan electrode are formed is sealed with a rear panel whereon an address electrode is formed. Here, both ends of the sustain electrodes are connected in common to a first common electrode and a second common electrode, and a sustain signal is simultaneously applied to both ends of the sustain electrodes.

Here, a third common electrode is further comprised which is connected to one of the first common electrode and the second electrode in an opposite position where a scan signal is applied to the scan electrode, and which is extended to the position whereto the scan signal is applied.

Additionally, a third common electrode is further comprised to connect the first common electrode and the second common electrode each other.

Preferably, the third common electrode is formed to have a broader width than that of the sustain electrode and to have a lower impedance.

PREFERRED EMBODIMENTS

Figure 4:
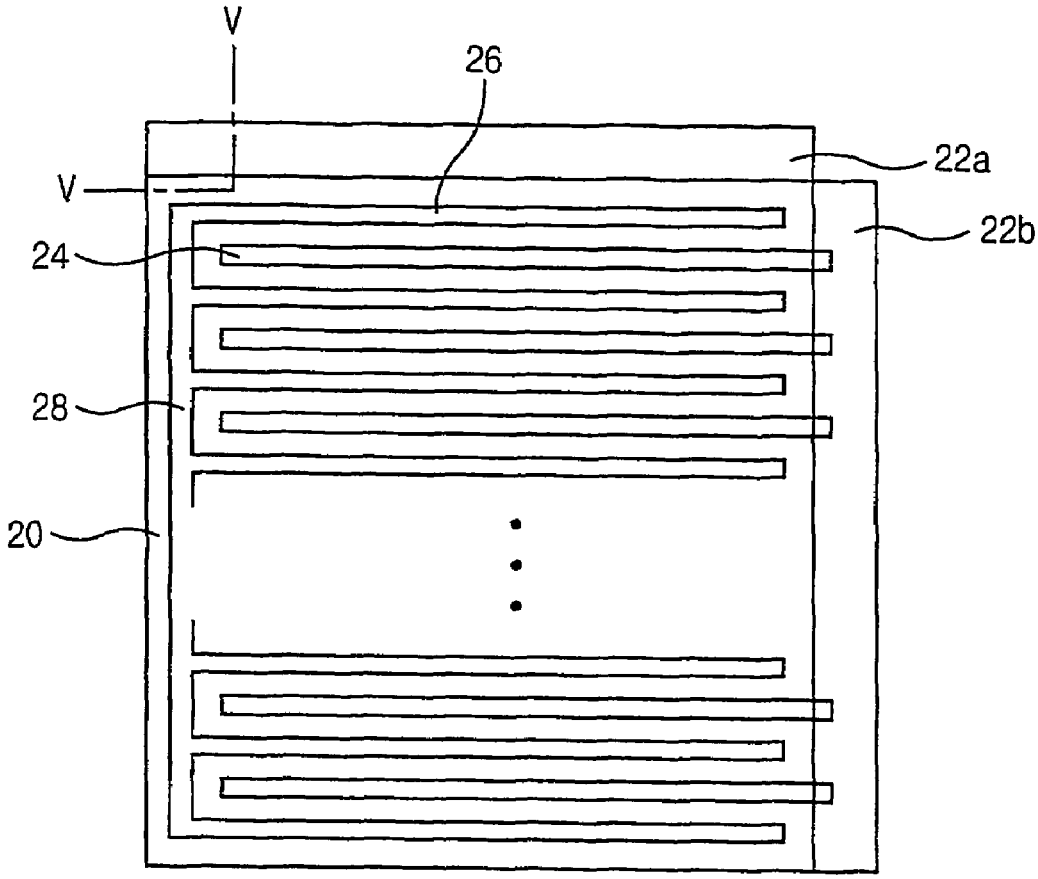
FIG. 4 is a plane view illustrating an example of a plasma display panel for a multi-screen according to an embodiment of the present invention.
Figure 5:
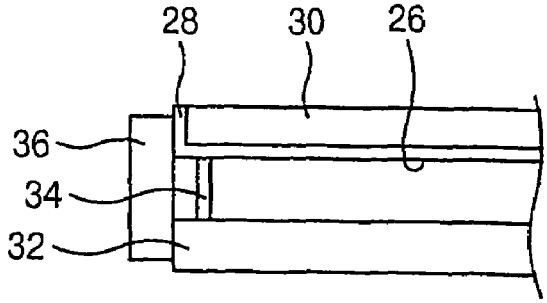
FIG. 5 is a cross-sectional view illustrating an electric connection state of the whole sustain electrodes X by one common electrode.

In an embodiment, a multi-screen is formed by combining a plurality of plasma display panels, and its embodiments are shown in FIGS. 4 and 5.

The multi-screen is formed by combining a plurality of plasma display panels (hereinafter, referred to as 'PDP'). In each PDP, a front panel is sealed with a rear panel. A scan electrode and a sustain electrode are formed on the front panel, and an address electrode is formed on the rear panel.

In the PDP 20 comprised in the multi-screen cut according to a sealing line, an electrode pad 22*a* wherein the rear panel is extended is formed on one side adjacent to a different PDP, and an electrode pad 22*b* wherein the front panel is extended is formed on the other side which is not adjacent to the different PDP.

In the front panel 20, an image is actually displayed on a region except the electrode pads 22*a* and 22*b*. An address electrode (not shown) whereto an address signal is applied is electrically connected to the electrode pad 22*a*. To the electrode pad 22*b* are electrically connected a scan electrode 24 whereto a scan signal is applied and a sustain electrode 26 whereto a sustain signal is applied.

The scan electrodes 24 are formed in parallel on a position corresponding to cells (not shown) for configuring a screen. One edge of each scan electrode 24 is extended to the electrode pad 22*b* and electrically connected to a scan driving circuit (not shown), and the other edge of each scan electrode 24 is extended to a location where the final cell is formed vertically.

The sustain electrodes 26 are formed horizontally in a position corresponding to cells for configuring a screen, and separated corresponding to each scan electrode 24 in a predetermined distance.

Here, the scan electrode 24 and the sustain electrode 26 are to form a screen by generating surface discharge in the same cell. Accordingly, it is preferable that the separation distance is determined depending on cell space.

A common electrode 28 is vertically formed adjacent to a side where the PDP is cut. To the common electrode 28 is one edge where the whole sustain electrode 26 is extended.

As described above, the whole sustain electrode 26 is electrically connected by one common electrode 28 as shown in FIG. 5. FIG. 5 is a V-V cross-sectional view of FIG. 4.

Referring to FIG. 5, cut cross sections of the front panel 30 and the rear panel 32 of the PDP are sealed with a sealant 34. The cutting sides are attached with a buffer material 36.

Here, the sustain electrode 26 is formed under the front panel 30, and the edge of the sustain electrode 26 is extended to a sidewall of the front panel 30. The common electrode 28 formed on the sidewall of the front panel 30 is connected to the sustain electrode 26.

Although the common electrode 28 is formed on the sidewall of the front panel 30 in FIG. 5, the common electrode 28 may be formed on the front panel 30 or on the same surface where the sustain electrode 26 is formed.

As shown in FIGS. 4 and 5, in the PDP according to an embodiment of the present invention, a scan signal is applied from the electrode pad 22*b*, and a sustain signal is applied from the common electrode 28.

The scan signal is applied opposite to the sustain signal, and resistant factors of corresponding electrodes are counteracted in each signal. As a result, each scan signal compensates each sustain signal in their transmission process, thereby uniformizing brightness of the whole surface of the PDP.

In the PDP according to the present invention, the side portion (P1 and P3 of FIG. 3) whereto the scan signal and the sustain signal are applied shows the brightness of about 210 $Cd/m^3$, and the middle portion (P2 of FIG. 3) shows the brightness of about 200 $Cd/m^3$.

Although the example wherein a common electrode is formed in one panel is described herein, the common line may be configured to be shared with the adjacent PDP because the multi-screen is formed by combining a plurality of PDPs. Here, a sustain driving circuit set in each PDP may be commonly applied, thereby reducing the number of components and inducing reduction of the manufacturing cost. The explanation of the above-described configuration is omitted because the configuration can be easily achieved by a person having an ordinary skill in the art.

In order to improve the brightness and discharge voltage condition of the PDP, a common electrode is formed so that a sustain signal may be applied bilaterally.

Figure 6:
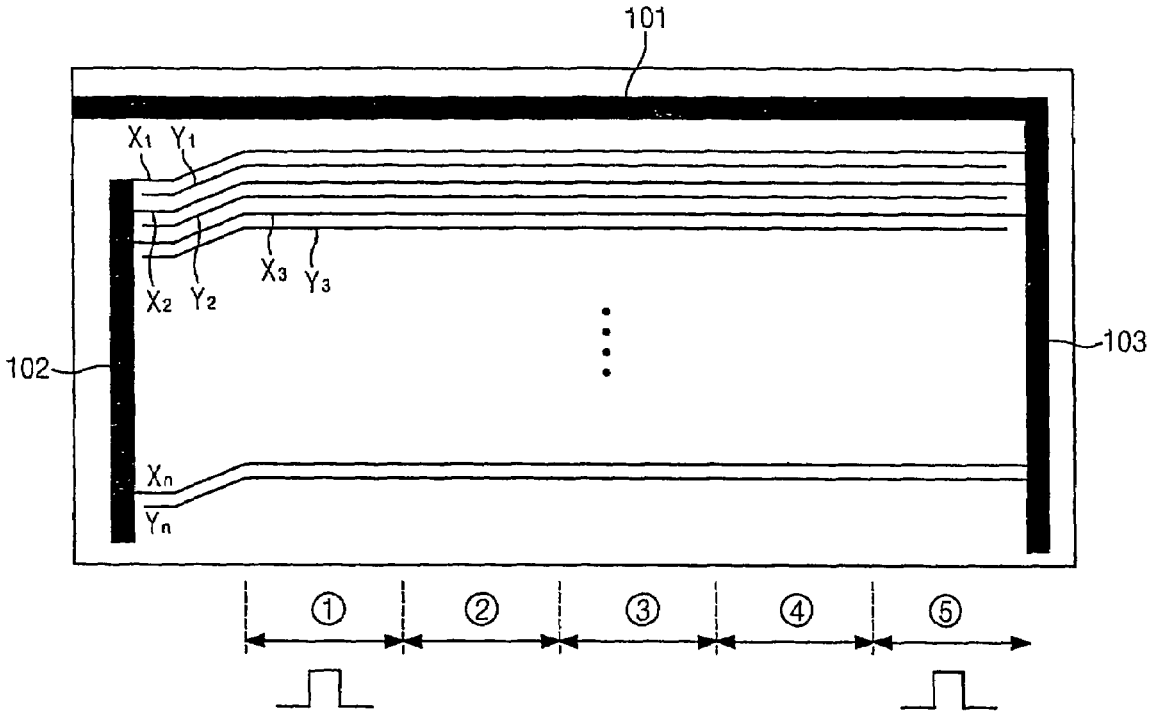
FIG. 6 is a plane view illustrating another example of a plasma display panel for a multi-screen according to an embodiment of the present invention.

In the embodiment of FIG. 6, each pair of a scan electrode and a sustain electrode is arranged in parallel, and scan electrodes $Y_1$~$Y_n$ and sustain electrodes $X_1$~$X_n$ are alternately arranged with each other. Both ends of each sustain electrode $X_1$~$X_n$ are connected in common.

Each end portion of the sustain electrodes $X_1$~$X_n$ which contact with a flexible printed circuit FCP is commonly connected to a common electrode 102. The end portion of the sustain electrodes $X_1$~$X_n$ which contact with other PDP is commonly connected to a common electrode 103.

The common electrode 103 is connected to an additional common electrode 101. The common electrode 101 is formed in parallel with the scan electrodes $Y_1$~$Y_n$ and the sustain electrodes $X_1$~$X_n$ and one side of the same panel with the common electrode 103. In order to minimize distortion of pulse waveforms applied to both ends of the sustain electrodes $X_1$~$X_n$ during the process of pulse, the common electrode 101 is formed of metal materials having a larger width than that of the scan electrodes $Y_1$~$Y_n$ and the sustain electrodes $X_1$~$X_n$ and a very low resistance such as Ag.

The common electrode 102 toward an electrode pad connected electrically to the FPC of both ends of the plurality of sustain electrodes $X_1$~$X_n$ connected in common connect end portions of the sustain electrodes $X_1$~$X_n$ commonly. The common electrode 103 connected to the other PDP connects commonly other end portions of the sustain electrodes X1~Xn and is also connected to the electrode pad through the common electrode 101.

Here, the common electrodes 102 and 103 are preferably formed of metals having a broader width and an excellent conductivity than those of the sustain electrodes $X_1$~$X_n$.

As the sustain electrodes $X_1$~$X_n$ are configured according to FIG. 6, the PDP performs a write or erase operation in each line if video effective data are transmitted into address electrodes.

After the write or erase operation is completed, scan pulse signals and sustain pulse signals are applied to the scan electrodes $Y_1$~$Y_n$ and the sustain electrodes $X_1$~$X_n$ on the electrode pad through the FPC by driving of a scan driver and a sustain driver. As a result, each cell performs a sustain operation for effective luminance.

The sustain pulse signals are applied to the common electrodes 101 and 102 on the electrode pad. The sustain pulse signal applied to the common electrode 101 is transmitted to the common electrode 103, and the sustain pulse signal applied to the common electrodes 102 and 103 is applied to both ends of the sustain electrodes $X_1$~$X_n$.

Figure 1:
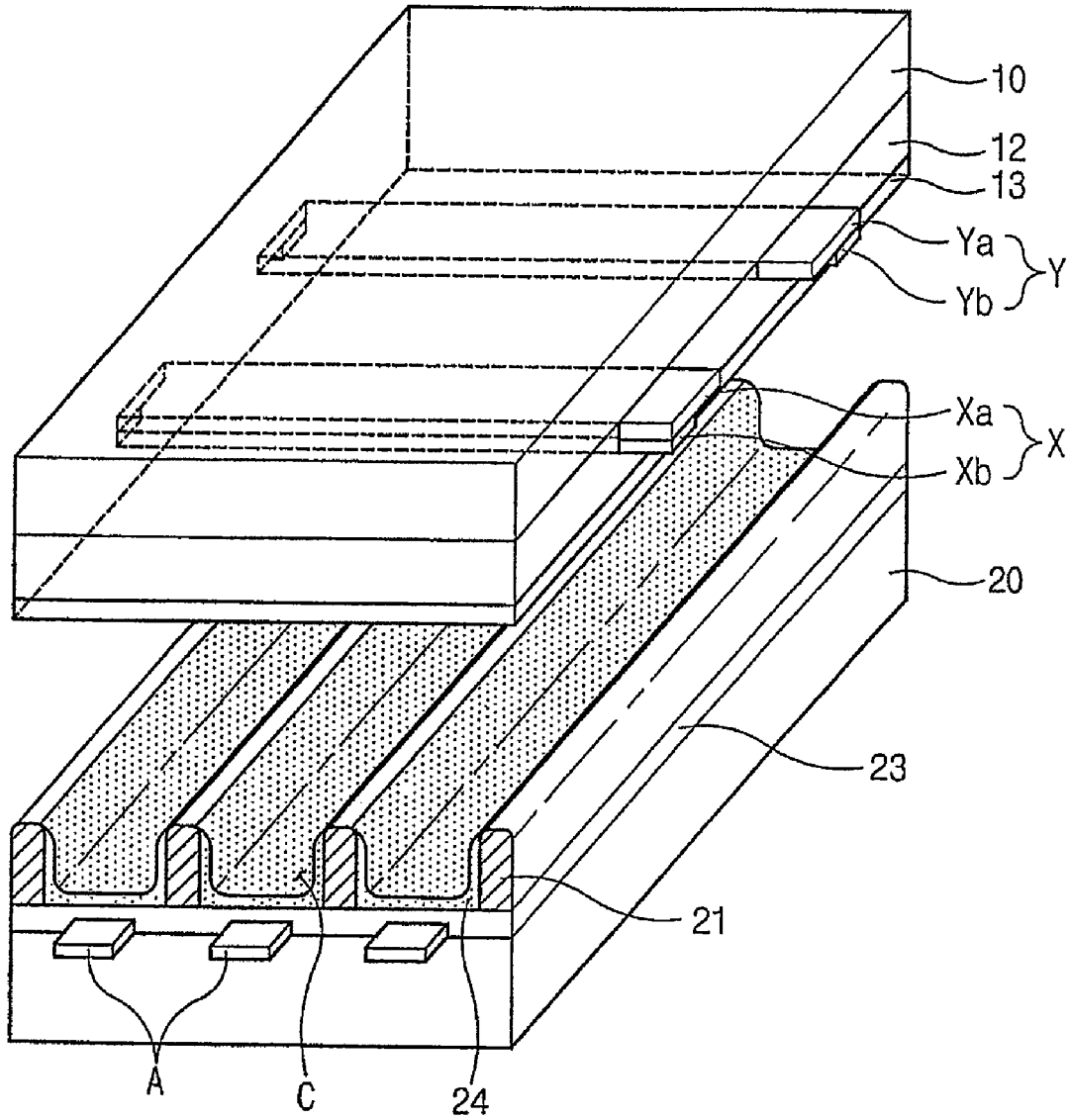
Fig.1 (PRIOR ART)
FIG. 1 is a perspective view illustrating a structure of a general plasma display panel.
Figure 2:
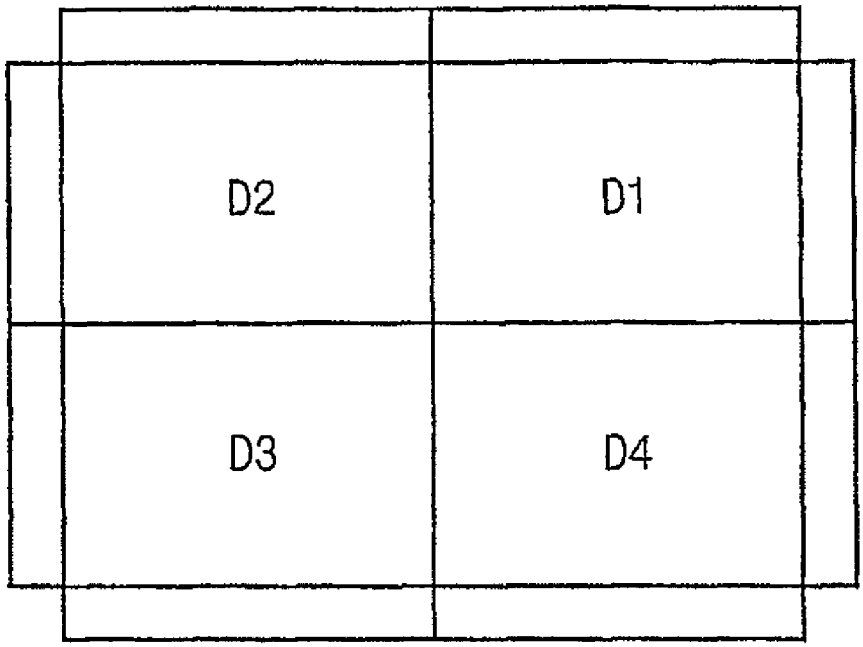
Fig.2 (PRIOR ART)
FIG. 2 is a plane view illustrating a multi-screen formed by combining unit plasma display panels.
Figure 3:
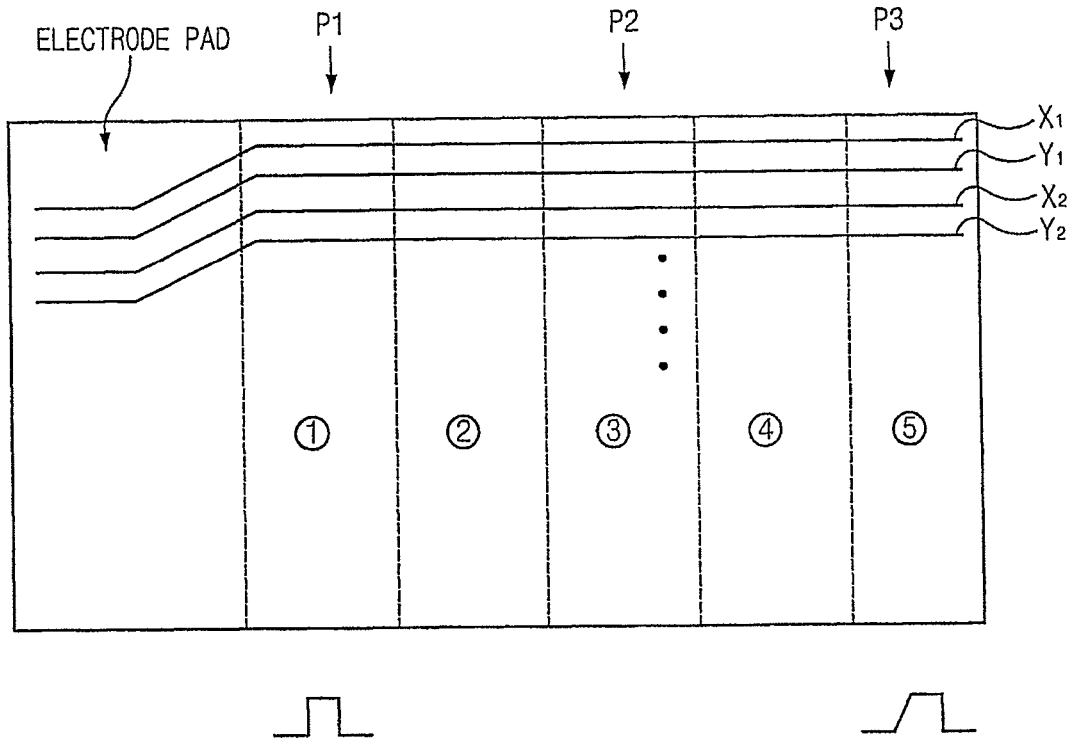
Fig.3 (PRIOR ART)
FIG. 3 is a diagram illustrating a sustain electrode X and a scan electrode Y when the multi-screen of FIG. 2 is formed.

The sustain pulse is not applied to one portion of the plurality of sustain electrodes $X_1$~$X_n$ as shown in FIG. 3 but to the common electrodes 102 and 103 connected to both ends of the sustain electrodes $X_1$~$X_n$ as shown in FIG. 6.

Since the sustain pulse signal is applied from both ends of the sustain electrodes $X_1$~$X_n$, distortion of waveforms which results from positions of the sustain electrodes $X_1$~$X_n$ is reduced, thereby uniformizing pulse types of the waveforms.

Preferably, the common electrode 101 which is formed of metals having a low resistance and a broad width is designed to have the minimized distortion of pulse waveforms so that they may be transmitted to the common electrode 103.

Figure 7:
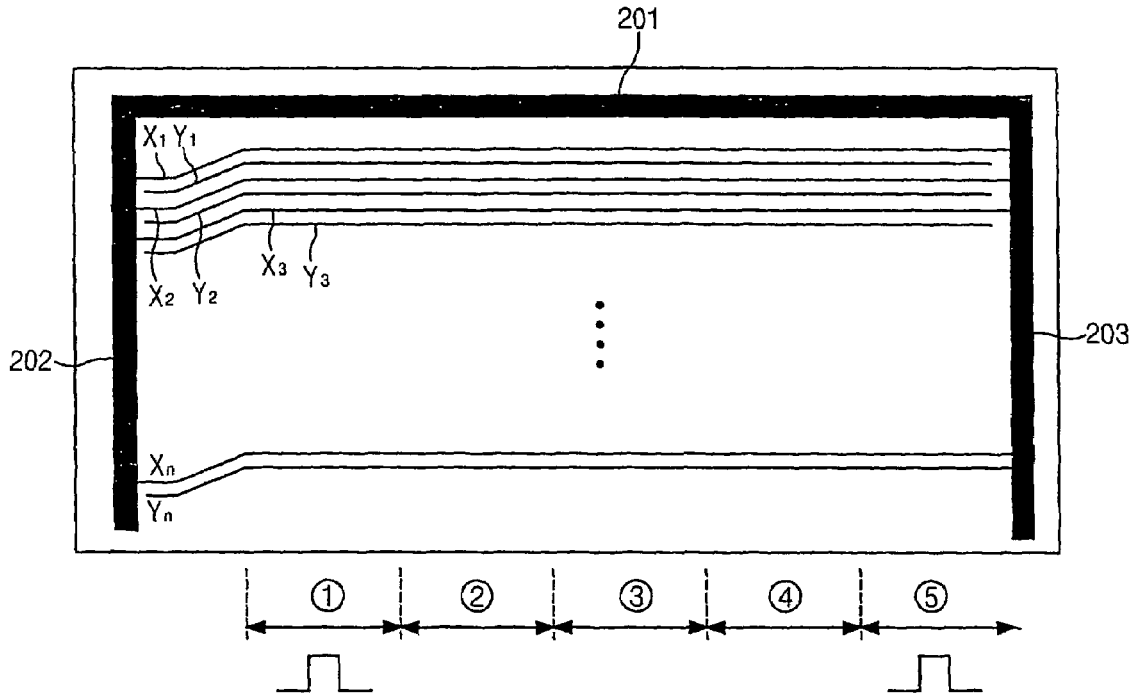
FIG. 7 is a plane view illustrating still another example of a plasma display penal for a multi-screen according to an embodiment of the present invention.

The common electrodes 201, 202 and 203 are all connected in the embodiment of FIG. 7 which is a transformed type of that of FIG. 6 while the common electrode 102 and 102 are separately connected in the embodiment of FIG. 6.

While the sustain pulse signals are applied to the common electrodes 102 and 101, respectively in the embodiment of FIG. 6, the common electrodes 201, 202 and 203 are interconnected in the embodiment of FIG. 7. As a result, although a sustain pulse is applied to one of the common electrodes 201, 202 and 203, a sustain pulse signal applied to both ends of the sustain electrodes $X_1$~Xn like the embodiment of FIG. 6. Therefore, pulses having not distorted but uniform waveforms are applied to the whole sustain electrodes X1~Xn. Additionally, since the waveforms are not distorted, differences of discharge voltage conditions are minimized in each cell.

INDUSTRIAL APPLICABILITY

In an embodiment according to the present invention, a scan signal and a sustain signal are applied oppositely from a front panel of a plasma display panel included in a multi-screen. As a result, effects on resistant factors works oppositely, thereby uniformizing brightness of the screen.

In addition, since sustain pulses are simultaneously applied to both ends of sustain electrodes connected in common, not distorted but uniform pulses can be applied to the whole sustain electrodes, thereby preventing degradation in quality of the PDP which results from brightness difference and driving voltage difference.

What is claimed is:

1. A plasma display panel for a multi-screen, comprising:

a plurality of unit plasma display panels wherein a front panel whereon a sustain electrode and a scan electrode are formed is sealed with a rear panel whereon an address electrode is formed, wherein both ends of the sustain electrodes are connected in common to a first common electrode and a second common electrode, wherein a sustain signal is simultaneously applied to both ends of the sustain electrodes from the first common electrode and the second common electrode, and a third common electrode connected to one of the first common electrode and the second common electrode in an opposite position where a scan signal is applied to the scan electrode, and extended to the position whereto the scan signal is applied.

2. A plasma display panel for a multi-screen, comprising:

a plurality of unit plasma display panels wherein a front panel whereon a sustain electrode and a scan electrode are formed is sealed with a rear panel whereon an address electrode is formed, wherein both ends of the sustain electrodes are connected in common to a first common electrode and a second common electrode, wherein a sustain signal is simultaneously applied to both ends of the sustain electrodes from the first common electrode and the second common electrode, and a third common electrode for connecting the first common electrode and the second common electrode each other.

3. The panel according to claim 1, wherein the third common electrode is formed to have a broader width than that of the sustain electrode and to have a low impedance.

4. The panel according to claim 2, wherein the third common electrode is formed to have a broader width than that of the sustain electrode and to have a low impedance.

* * * * *